US007950657B2

(12) United States Patent
Fushimi

(10) Patent No.: US 7,950,657 B2
(45) Date of Patent: May 31, 2011

(54) PRINTING APPARATUS

(75) Inventor: Takahiro Fushimi, Inashiki-gun (JP)

(73) Assignee: Riso Kagaku Corporation, Tokyo (JP)

( * ) Notice: Subject to any disclaimer, the term of this patent is extended or adjusted under 35 U.S.C. 154(b) by 41 days.

(21) Appl. No.: 12/585,064

(22) Filed: Sep. 2, 2009

(65) Prior Publication Data

US 2010/0052248 A1 Mar. 4, 2010

(30) Foreign Application Priority Data

Sep. 3, 2008 (JP) ..... 2008-226285

(51) Int. Cl.
*B65H 7/12* (2006.01)

(52) U.S. Cl. ..... 271/262; 271/265.04

(58) Field of Classification Search ..... 271/110, 271/262, 263, 265.04
See application file for complete search history.

(56) References Cited

U.S. PATENT DOCUMENTS 6,040,923 A * 3/2000 Takashimizu et al. ..... 358/498
7,347,419 B2 * 3/2008 Sano et al. ..... 271/265.04

FOREIGN PATENT DOCUMENTS

JP 2001-063872 3/2001

* cited by examiner

*Primary Examiner* — Kaitlin S Joerger
(74) *Attorney, Agent, or Firm* — The Nath Law Group; Jerald L. Meyer; Jiaxiao Zhang

(57) ABSTRACT

A printing apparatus includes: a printing mechanism forming an image on a sheet transferred in a sheet transfer route; a sheet feeding mechanism feeding sheets to the sheet transfer route; a register provided between the sheet feeding mechanism and the printing mechanism on the sheet transfer route so as to position a sheet fed from the sheet feeding mechanism and adjust an obliqueness of the sheet; an edge part detector provided on the sheet transfer route having a detecting section configured between the register and the printing mechanism so as to detect edge parts of a sheet transferred to the printing mechanism by the register, wherein the edge part detector is configured to serve as a multi-feed detector to detect multi-feeding of sheets.

1 Claim, 8 Drawing Sheets

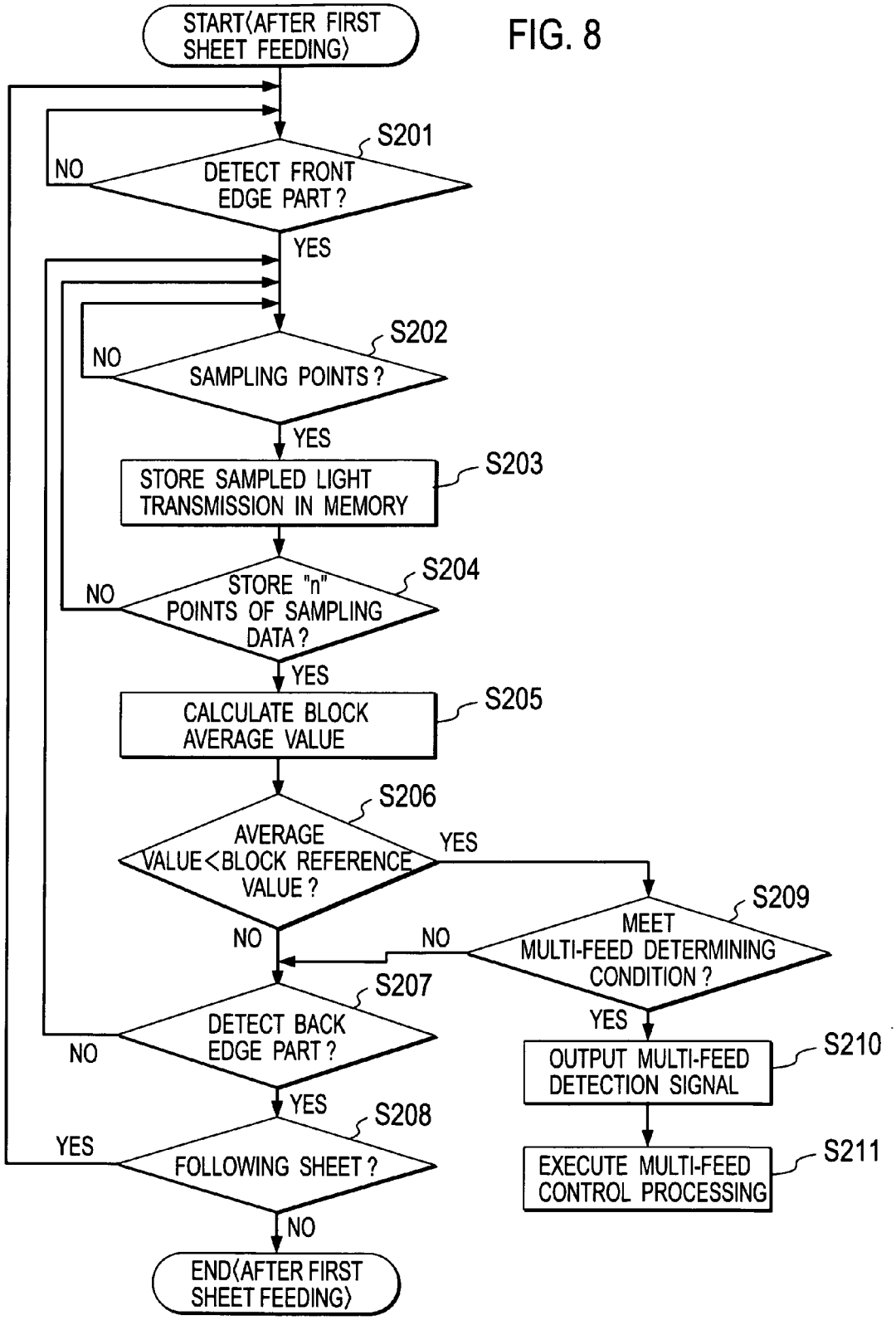
FIG. 8
START〈AFTER FIRST SHEET FEEDING〉
S201
DETECT FRONT EDGE PART ?
NO
YES
S202
SAMPLING POINTS ?
NO
YES
S203
STORE SAMPLED LIGHT TRANSMISSION IN MEMORY
S204
STORE "n" POINTS OF SAMPLING DATA ?
NO
YES
S205
CALCULATE BLOCK AVERAGE VALUE
S206
AVERAGE VALUE<BLOCK REFERENCE VALUE ?
YES
NO
S209
MEET MULTI-FEED DETERMINING CONDITION ?
NO
YES
S207
DETECT BACK EDGE PART ?
NO
YES
S210
OUTPUT MULTI-FEED DETECTION SIGNAL
S211
EXECUTE MULTI-FEED CONTROL PROCESSING
S208
FOLLOWING SHEET ?
YES
NO
END〈AFTER FIRST SHEET FEEDING〉

PRINTING APPARATUS

BACKGROUND OF THE INVENTION

1. Field of the Invention

The present invention relates to a printing apparatus to detect multi-feeding of sheets transferred along a sheet transfer route.

2. Description of the Related Art

A printing apparatus circulates a plurality of sheets separately by feeding one by one from a stack of sheets in a sheet feed rack of a feeding mechanism. Meanwhile, the plurality of sheets may be overlapped and transferred together when passing through a printing mechanism. This is so-called "multi-feeding of sheets". Japanese Patent Laid-Open Publication No. 2001-063872 discloses a technology for detecting multi-feeding of sheets by means of a light transmission sensor as a multi-feed detection sensor provided on a sheet transfer route. The light transmission sensor measures the amount of light transmission of a sheet on the sheet transfer route so as to detect the multi-feeding of sheets since the amount of light transmission is dependent on a thickness of a sheet.

FIG. 1A shows one example of conventional arrangements of light transmission sensors used for detecting multi-feeding of sheets. In this figure, a sheet from a sheet feeding side is transferred to register rollers 750 to pause for positioning a front edge part of the sheet. Then, the sheet is guided to print heads 712 by the register rollers 750.

In the sheet transfer route, a light transmission sensor 760 composed of a light emitter 762 and a light-receiving sensor 764 is provided on the sheet feeding side of the register rollers 750. While, a light transmission sensor 770 composed of a light emitter 772 and a light-receiving sensor 774 is provided on a sheet exit side of the register rollers 750. The light transmission sensor 760 serves as a register sensor to detect a sheet entering the register rollers 750. The light transmission sensor 770 serves as an edge part detection sensor to detect edge parts of the sheet further transferred to the print heads 712.

The light transmission sensor 760 provided on the sheet feeding side of the register rollers 750 also serves as a multi-feed detection sensor in order to detect multi-feeding of sheets on the feeding side as quickly as possible.

SUMMARY OF THE INVENTION

The register rollers 750 are used for positioning a front edge part of sheets, and for adjusting oblique sheets. A sheet P enters the register rollers 750 with an excessive feed slightly toward the print head side by sheet feeding rollers not shown in the figure. Then, the sheet P pauses loosely at the register rollers 750 as shown in FIG. 1B in order for an adjustment of a sheet obliqueness. The light transmission sensor 760 as a multi-feed detection sensor is provided on the sheet feeding side of the register rollers 750 as mentioned above. Accordingly, the light transmission sensor 760 detects the amount of light transmission of the loose sheet.

In such a case, the light transmission sensor 760 may detect the amount of light transmission variously per sheet since a loose state differs in each fed sheet. In addition, when there are several feeding mechanisms in a printing apparatus, there are also several feeding routes to transfer a sheet to the register rollers 750 per feeding mechanism. Thus, the light transmission sensor 760 may also detect the amount of light transmission variously per sheet (feeding route). As a result, the conventional multi-feed detecting method as shown in FIG. 1A may not be able to stabilize the accuracy of multi-feed detection.

The present invention has been made to solve the above-mentioned issues. It is an object of the present invention to improve the accuracy of multi-feed detection.

To achieve the above-mentioned object, according to an aspect of the present invention, a printing apparatus comprises: a printing mechanism forming an image on a sheet transferred in a sheet transfer route; a sheet feeding mechanism feeding sheets to the sheet transfer route; a register provided between the sheet feeding mechanism and the printing mechanism on the sheet transfer route so as to position a sheet fed from the sheet feeding mechanism and adjust an obliqueness of the sheet; an edge part detector provided on the sheet transfer route having a detecting section configured between the register and the printing mechanism so as to detect edge parts of a sheet transferred to the printing mechanism by the register, the edge part detector is configured to serve as a multi-feed detector to detect multi-feeding of sheets.

According to the present invention, the edge part detector provided so as to detect edge parts of a sheet in a detecting section configured between the register and the printing mechanism is also used as a multi-feed detector. Therefore, it is possible to detect multi-feeding of sheets with more stable behavior in the detecting section compared with sheets transferred from the feeding mechanism to the register. Thus, the accuracy of multi-feed detection can be improved.

BRIEF DESCRIPTION OF THE DRAWINGS

FIG. 8 is a flow chart showing multi-feed determination processing after first sheet feeding.

DETAILED DESCRIPTION OF THE PREFERRED EMBODIMENT

Figure 1A:
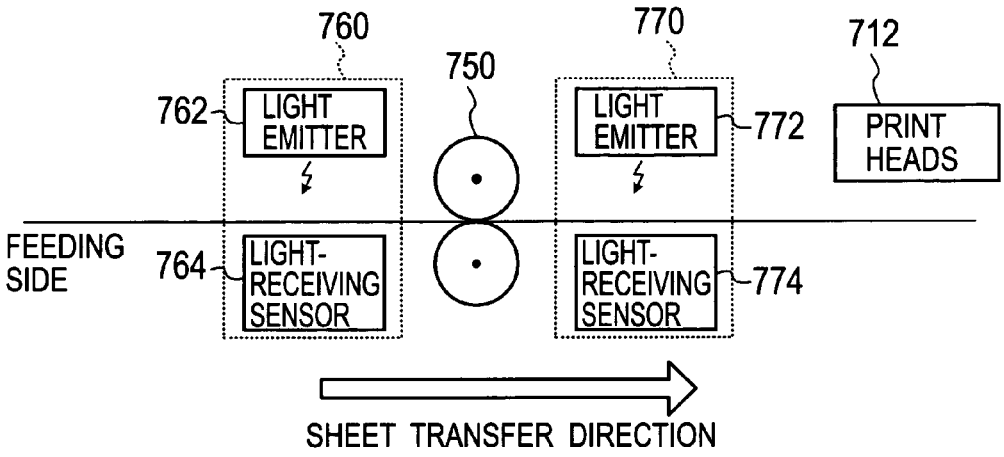
FIGS. 1A and 1B are views showing one example of conventional arrangements of light transmission sensors used for detecting multi-feeding of sheets.
Figure 1B:
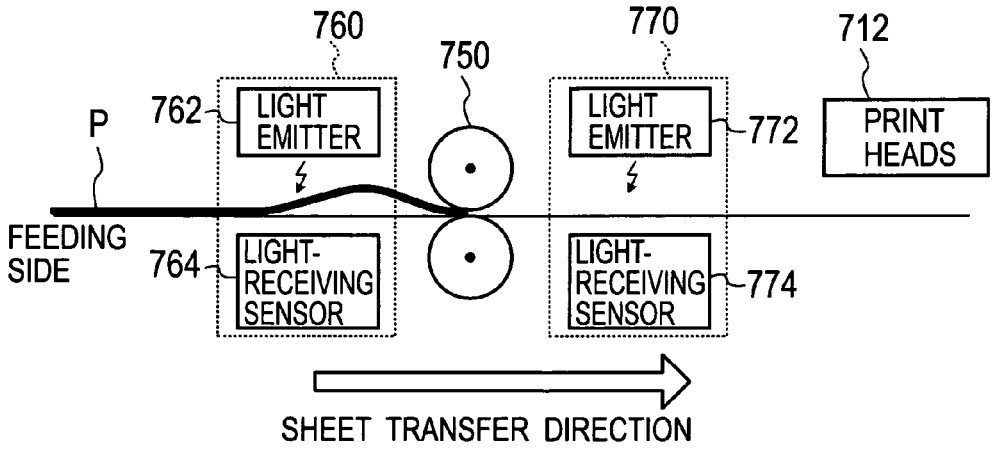
Figure 2:
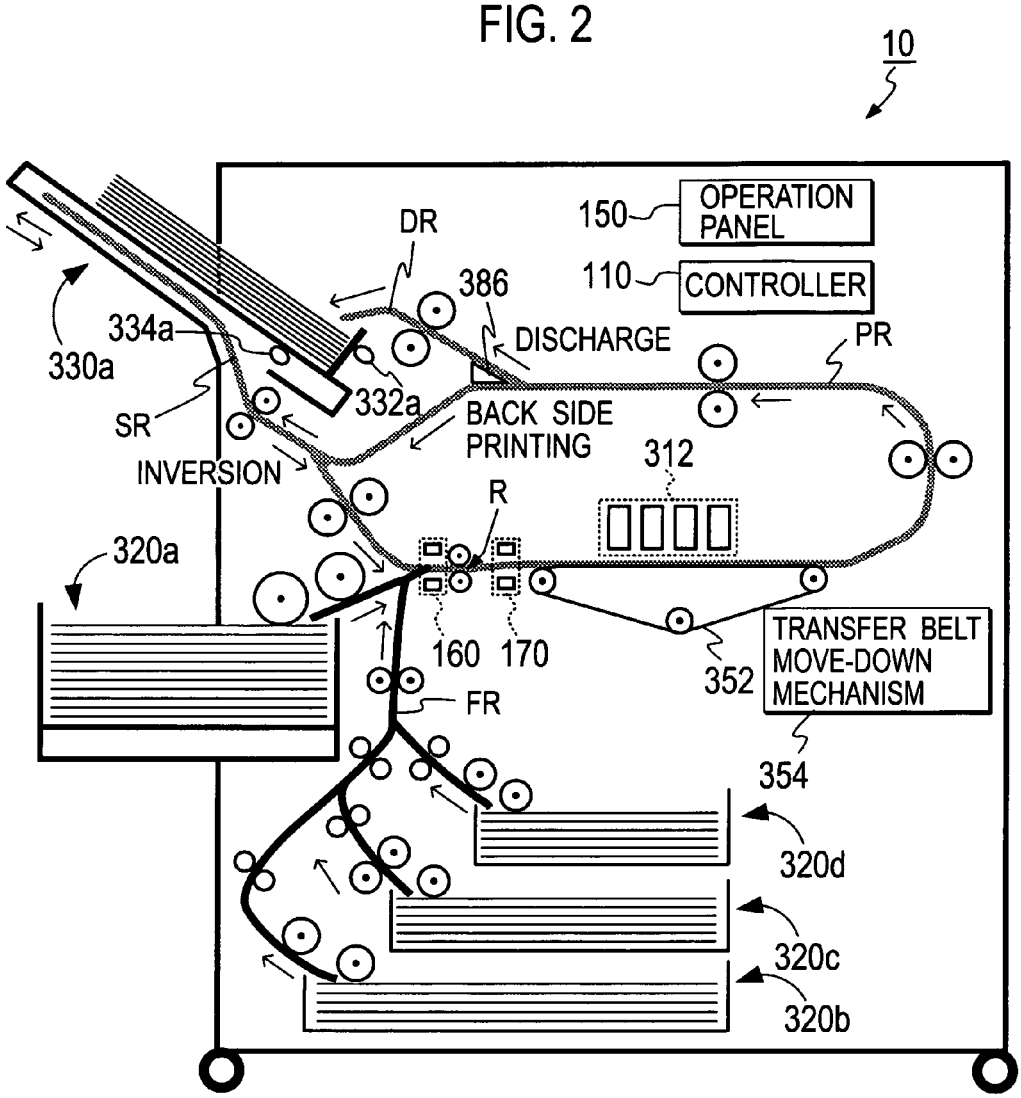
FIG. 2 is a block diagram showing one example of configurations of a printing apparatus mainly including feeding mechanisms, a discharge mechanism and a printing mechanism.

We now describe an embodiment of the present invention with reference to the drawings. FIG. 2 is a block diagram showing one example of configurations of a printing apparatus 10 mainly including feeding mechanisms, a discharge mechanism and a printing mechanism according to the present embodiment. As shown in the figure, the printing apparatus 10 has the sheet feeding mechanisms including a sheet feed rack 320*a*, a first feed tray 320*b*, a second feed tray 320*c* and a third feed tray 320*d*, and the sheet discharge mechanism including a face-down discharge tray 330*a* In addition, the printing apparatus 10 may have optional discharge trays. The printing apparatus 10 may concurrently have some functions such as punching and stapling afterward, and may have a face-up discharge tray.

The printing apparatus 10 has a sheet transfer route TR that includes a system of feeding routes FR for feeding a sheet, a discharging route DR for discharging the sheet, a normal transfer route PR for transferring the sheet received from the system of feeding routes FR to the discharging route DR, and an inverting route (switchback) SR branched from the normal transfer route PR, for inverting the sheet between front and back sides received from the normal transfer route PR to re-feed to the normal transfer route PR. The inverting route SR cooperates with the normal transfer route PR to constitute a looped sheet circulating transfer route CR.

The printing apparatus 10 executes printing on a sheet fed from any feeding mechanism at print heads 312, and discharges the sheet to the face-down discharge tray 330*a*. The face-down discharge tray 330*a* is provided at an upper part of a side surface of the printing apparatus 10, to which the printed sheet is discharged with a printed side down.

The printing apparatus 10 has the printing mechanism including a plurality of print heads 312, each of which is provided with multiple nozzles formed perpendicular to a sheet transfer direction. Each of the print heads 312 propels droplets of black or color ink for printing in color bylines. The printing apparatus 10 has a controller 110 composed of a substrate with a mounted CPU, memories, etc., an operation panel 150 for interfacing user operations, and other components not illustrated in the figure.

A sheet is fed one by one from any feeding mechanism and transferred along the system of feeding routes FR in a casing by an associated drive mechanism such as rollers, and guided to a register R. The register R is located near a junction of the system of feeding routes FR and the normal transfer route PR. The register R is composed of a pair of register rollers for positioning a front edge of the fed sheet. The fed sheet pauses at the register R for an adjustment of a sheet obliqueness. The fed sheet enters the register R with a slightly excessive feed and pauses loosely by means of sheet feeding rollers of the feeding mechanism from which the sheet is fed in order for the adjustment of the sheet obliqueness. The adjusted sheet is transferred to the normal transfer route PR provided with the printing mechanism at a controlled timing.

In the sheet transfer route TR, a first light transmission sensor 160 is provided on a sheet feeding side of the register R, and a second light transmission sensor 170 is provided on a sheet exit side of the register R. The first light transmission sensor 160 serves as a register sensor to detect a sheet being fed to the register R. The second light transmission sensor 170 serves as a sheet edge part detection sensor, and also, as a multi-feed detection sensor.

Figure 3:
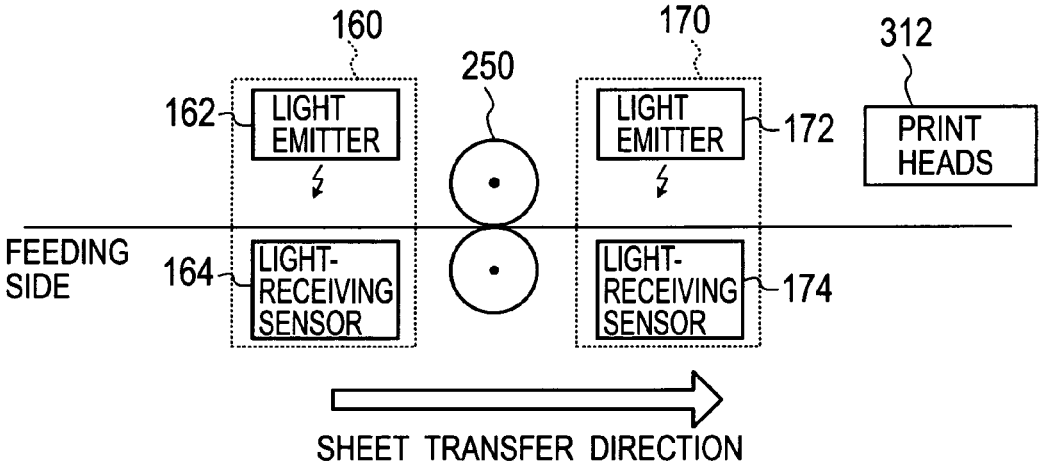
FIG. 3 is a view showing a positional relationship among register rollers, light transmission sensors and print heads.

FIG. 3 is a view showing a positional relationship among register rollers 250 composing the register R, the first light transmission sensor 160, the second light transmission sensor 170 and the print heads 312. As shown in the figure, the first light transmission sensor 160 as a register sensor includes a light emitter 162 and a light-receiving sensor 164. Also, the second light transmission sensor 170 as a sheet edge part and multi-feed detection sensor includes a light emitter 172 and a light-receiving sensor 174.

The second light transmission sensor 170 detects edge parts of a sheet P transferred to the print heads 312, and detects multi-feeding of sheets. According to the present embodiment, the sheet edge part detection sensor, which is provided on the sheet exit side of the register rollers 250, is also used as a multi-feed detection sensor. The sheet P pauses at the register R, and is transferred to the print heads 312 by the register rollers 250. Therefore, the sheet P passing through the second light transmission sensor 170 is not influenced in the multi-feed detection by sheet looseness at the register R and a distinction of feeding routes. Thus, the second light transmission sensor 170 can examine each sheet evenly with less variability in the multi-feed detection. As a result, the accuracy of multi-feed detection can be enhanced.

Figure 4A:
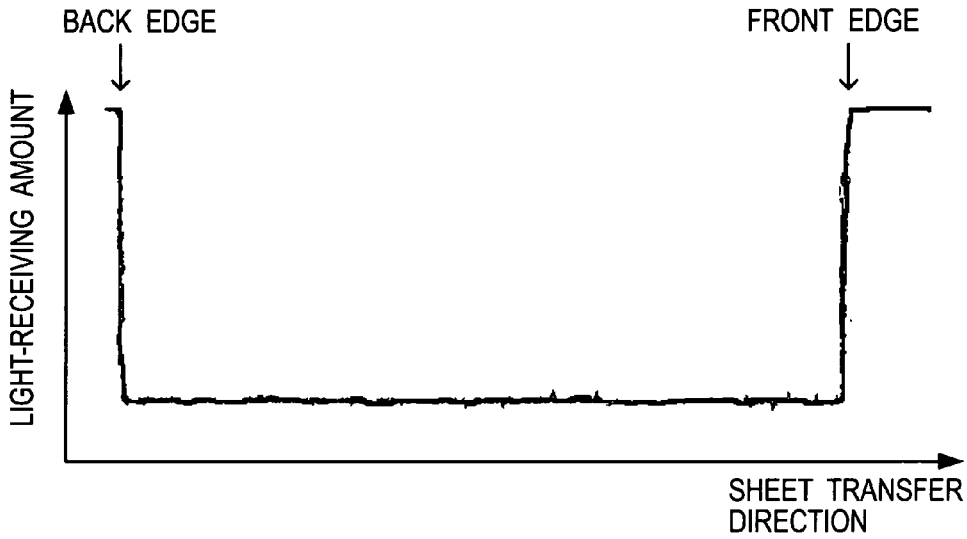
FIGS. 4A and 4B are views showing the received light amount of a sheet passing through light transmission sensors.
Figure 4B:
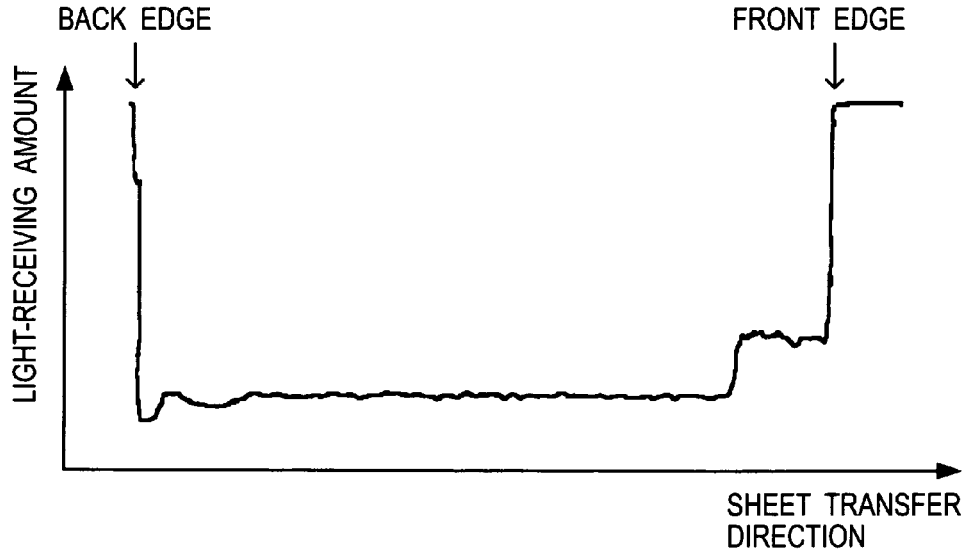

FIG. 4A is a view showing one example of the received light amount of the sheet P detected at the light-receiving sensor 174 of the second light transmission sensor 170 provided on the sheet exit side of the register rollers 250. FIG. 4B is a view showing one example of the received light amount of the sheet P detected at the light-receiving sensor 164 of the second light transmission sensor 160 provided on the sheet feeding side of the register rollers 250.

As shown in the figures, the received light amount of the sheet P detected at the light-receiving sensor 174 of the second light transmission sensor 170 is kept at an approximately constant value throughout a part from a front edge to a back edge of the sheet. While, the received light amount of the sheet P detected at the light-receiving sensor 164 of the second light transmission sensor 160 varies precariously throughout the sheet. In particular, the received light amount of the sheet P varies in a stepwise manner when the front edge part of the sheet P passes through the sensor. Thus, the accuracy of multi-feed detection can be improved due to the light-receiving sensor 174 of the second light transmission sensor 170 provided on the sheet exit side of the register rollers 250.

As shown in FIG. 2 again, a sheet is transferred at a controlled speed depending on printing conditions by a transfer belt 352 that is looped and provided facing an ink-droplet-propelling side of the print heads 312. While, an image is formed on the sheet by ink droplets propelled from the print heads 312 by lines. The transfer belt 352 has a transfer belt move-down mechanism 354 capable of moving the transfer belt 352 downward. The transfer belt move-down mechanism 354 moves the transfer belt 352 downward so that sheets around the transfer belt 352 are easily removed when a transfer jam and multi-feeding of sheets is detected.

For one-side printing, a sheet printed on a front side is transferred in the casing by drive mechanisms such as rollers. Then, the sheet is guided to the face-down discharge tray 330*a* to be discharged by a route selecting mechanism 386, and stacked on the face-down discharge tray 330*a* with a printed side down.

The face-down discharge tray 330*a* is formed in a shape of a tray protruding from the casing with a certain thickness. The face-down discharge tray 330*a* is inclined to a lateral wall of the casing. Thus, the discharged sheet is slid down along an inclination of the face-down discharge tray 330*a* so as to tidily pile up on the face-down discharge tray 330*a* in due course.

The face-down discharge tray 330*a* has a prearranged sheet pile-up capacity. Thus, the face-down discharge tray 330*a* is provided with a tray full sensor 332*a* to detect whether sheets being piled up on the face-down discharge tray 330*a* reaches a predetermined level near the maximum pile-up capacity. Concurrently, the face-down discharge tray 330*a* is provided with a tray empty sensor 334*a* to detect whether the face-down discharge tray 330*a* is empty.

For both-side printing, assuming "a front side" as the side to be printed first and "a back side" as the side to be printed next, a sheet printed on the front side is to be transferred in the casing without being guided to the face-down discharge tray 330*a* by the route selecting mechanism 386. The sheet is transferred to the inversion route SR to be switched back for inversion between the front side and the back side. The sheet is re-fed to the register R by the drive mechanisms such as rollers. After a pause at the register R, the sheet is transferred to the printing mechanism at a controlled timing.

Then, the sheet is to have an image formed on the back side in a similar manner to the front side. The sheet with images on both sides is discharged to and piled on the face-down discharge tray 330*a*.

In the printing apparatus 10, an internal space of the face-down discharge tray 330*a* is used to implement a switchback for both-side printing. The space in the face-down discharge tray 330*a* is enclosed to keep sheets from being taken from outside in the course of the switchback. This prevents the sheets from being pulled out by a mistake of user in the course of the switchback. The face-down discharge tray 330*a*, which is an inherent member to the printing apparatus 10, affords to eliminate provision of an extra space for the switchback in the printing apparatus 10. This permits the casing to be kept from being enlarged in size. The inverting route SR that is separated from the face-down discharge tray 330*a* allows for parallel operations between a sheet to be switched back and another sheet to be discharged.

Figure 5:
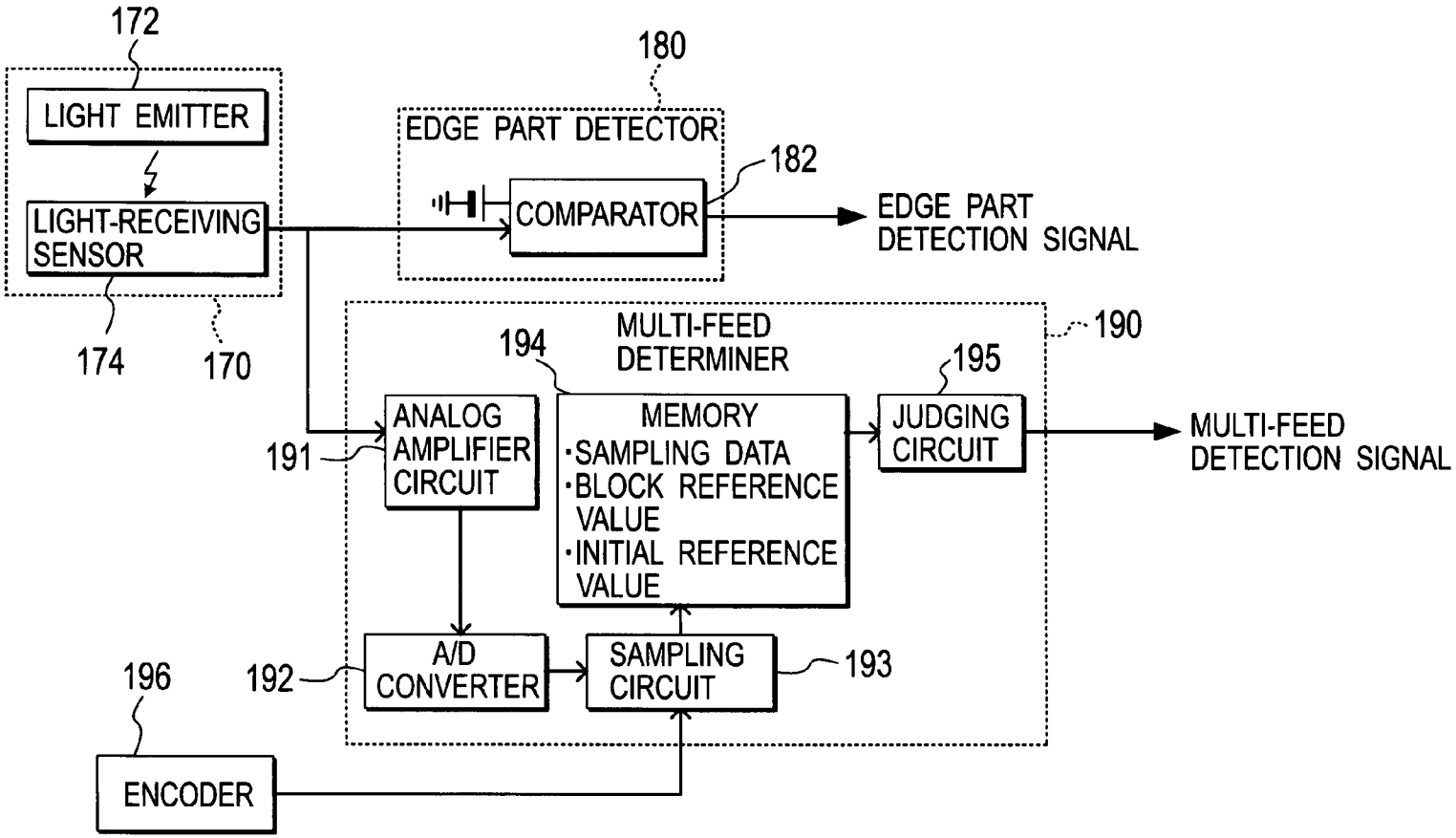
FIG. 5 is a block diagram showing a configuration of an edge part and multi-feeding sheet detection system.

FIG. 5 is a block diagram showing a configuration of an edge part and multi-feeding sheet detection system, which serves as a detector to detect edge parts and multi-feeding of sheets. As shown in the figure, the edge part and multi-feed sheet detection system is composed of the second light transmission sensor 170, an edge part detector 180, a multi-feed determiner 190 and an encoder 196. As described above, the second light transmission sensor 170 is provided on the sheet exit side of the register rollers 250. The encoder 196 outputs a one-shot pulse signal when the register rollers 250 are rotated a predetermined length of a sheet sent thereby.

The second light transmission sensor 170 includes the light emitter 172, and the light-receiving sensor 174 provided so as to receive light emitted from the light emitter 172 and output an electrical signal according to the amount of the received light. The light emitter 172 can be composed of a light-emitting diode, a laser diode, a lamp, and the like. The light-receiving sensor 174 can be composed of, for instance, a photo diode.

When there is no sheet between the light emitter 172 and the light-receiving sensor 174, the light-receiving sensor 174 directly receives light emitted from the light emitter 172. While, the light-receiving sensor 174 indirectly receives light emitted from the light emitter 172 through a sheet (or sheets) when there is any sheet therebetween. Therefore, the received light amount of the light-receiving sensor 174 is dependent on the presence or absence of sheet, the number of sheets, a sheet thickness, etc. Thus, the passage of a front edge part, the passage of a back edge part and the multi-feeding of sheets are detectable based on the electrical signal transmitted from the light-receiving sensor 174. Note that other types of sensors, such as a light reflection sensor, may be appropriately used instead of a light transmission sensor.

The edge part detector 180 includes a comparator 182. The comparator 182 compares an output signal from the light-receiving sensor 174 with a predetermined voltage value to determine the presence or absence of sheet. Then, the comparator 182 outputs the comparative result as an edge part detection signal. Thus, the edge part detector 180 can detect front and back edge parts of a sheet passing through the second light transmission sensor 170 by monitoring a rising edge and a trailing edge of the edge part detection signal from the comparator 182.

The multi-feed detector 190 includes an analog amplifier circuit 191, an A/D converter 192, a sampling circuit 193, a memory 194 and a judging circuit 195. Those functional components are realized as hardware by means of the controller 110 composed of a CPU, RAM, ROM, integrated circuit, and the like.

The analog amplifier circuit 191 amplifies an output signal based on the received light amount of the light-receiving sensor 174 so as to transmit to the A/D converter 192. The A/D converter 192 converts the signal from the analog amplifier circuit 191 into a digital signal based on the analog value so as to transmit to the sampling circuit 193. The sampling circuit 193 samples the digital signal from the A/D converter 192 at a controlled timing based on a one-shot pulse signal from the encoder 196 so as to store in the memory 194.

Figure 6:
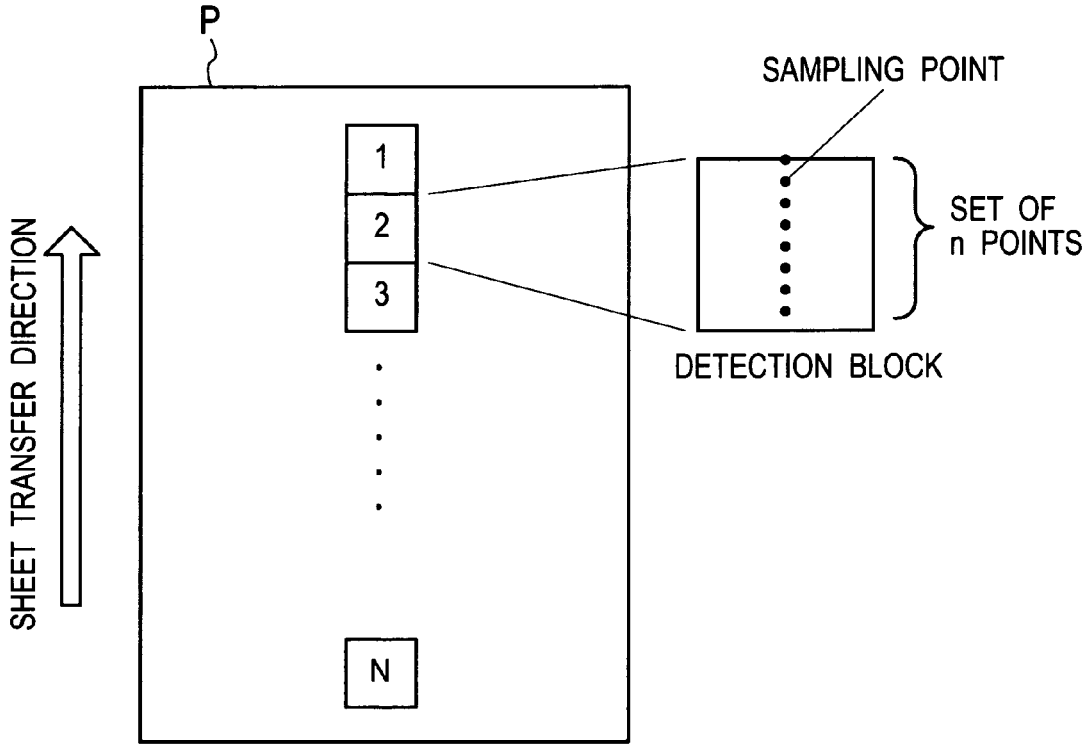
FIG. 6 is a view showing detection blocks and sampling points for multi-feed detection.

Next, we explain a method of multi-feed detection of the present embodiment. According to the present invention as shown in FIG. 6, a sheet P is segmented into "N" detection blocks along a sheet transfer direction. Then, each detection block is assigned with "n" sampling points. The number "N" of the detection blocks is determined depending on the length of the sheet P along the sheet transfer direction. Preferably, the sheet P is segmented so as to leave a certain margin at a mostfront edge part on the sheet P in view of a response lag of the light-receiving sensor 174.

Then, an output signal from the A/D converter 192 per sampling point in one detection block is sampled to obtain sampling data. After every sampling data of the sampling points in the detection block is obtained, an average value of the sampling data in the detection block is calculated.

By comparing the calculated average value with a reference value preliminarily assigned in the detection block, the possibility that multi-feeding happens in the detection block is predicted. When there are two sequential detection blocks predicted to have a possibility from multi-feeding, a multi-feed detection signal is transmitted due to the determination of multi-feeding of sheets. The judging circuit 195 serves as a component to execute calculation processing of the average value of sampling data, prediction processing of a possibility for multi-feeding, and determination processing of multi-feeding.

Next, we explain a reference value in prediction processing of a possibility for multi-feeding. After first sheet feeding, the average value of sampling data per detection block calculated in first sheet feeding is used as a reference value of each corresponding detection block of a second sheet and the following sheets. In other words, multi-feeding of sheets after first sheet feeding is determined based on sampling data of a first sheet P. For the first sheet P, it is employed a predetermined common initial value as a reference value for each detection block. Such an initial value as a reference value varies based on types of sheets. Thus, for instance, several initial values may be arranged in advance according to the type of the sheet P.

Therefore, the memory 194 has a section to store "n" sampling data to be calculated per detection block, a section to store "N" reference values of respective detection blocks, and a section to preliminarily store an initial reference value.

Figure 7:
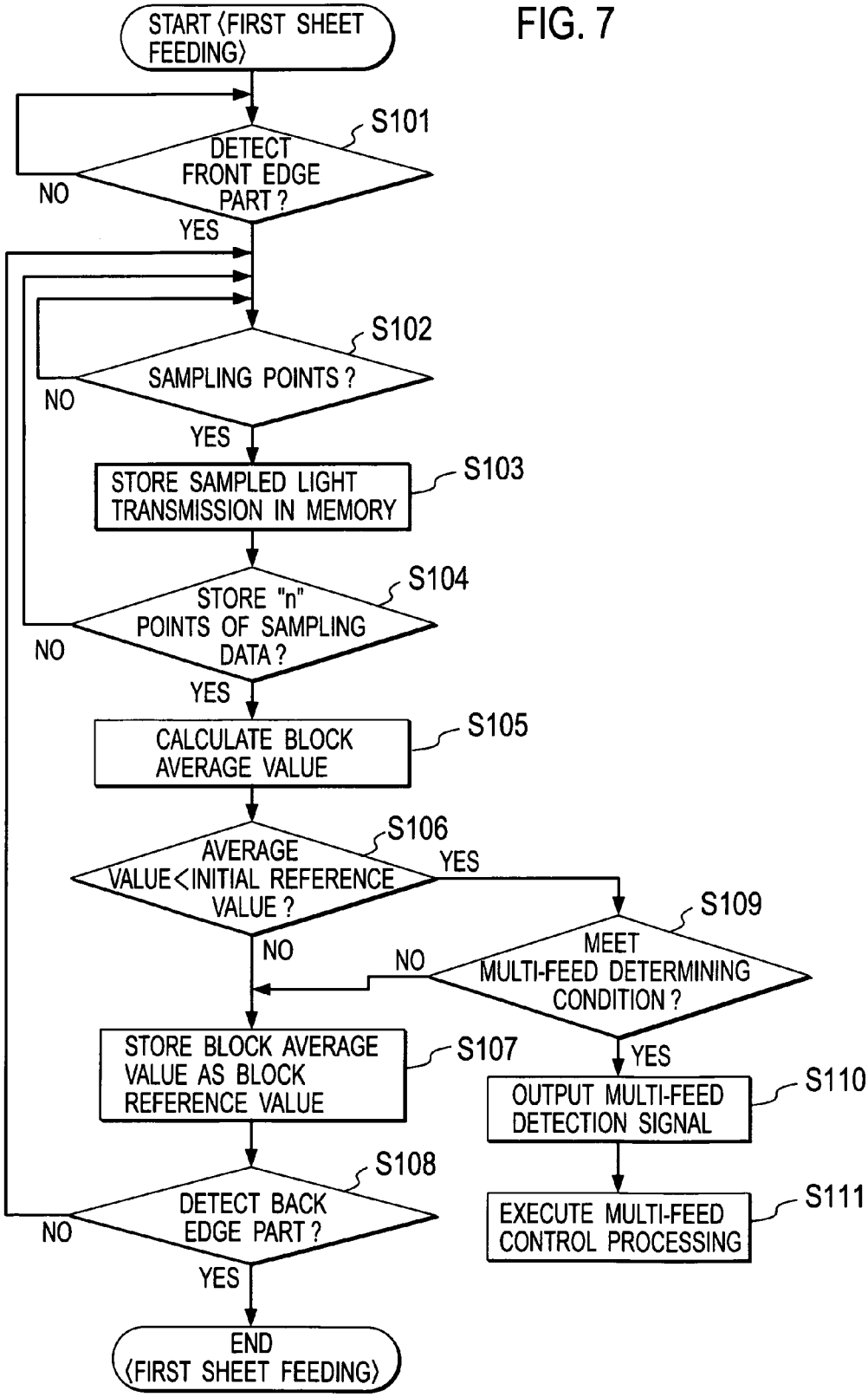
FIG. 7 is a flow chart showing multi-feed determination processing of first sheet feeding.

Then, we describe a flow of multi-feed determination processing in the multi-feed determiner 190. FIG. 7 is a flow chart showing multi-feed determination processing in first sheet feeding.

When the second light transmission sensor 170 detects a front edge part of a first sheet after feeding (S101: Yes), a sampling point in a first detection block is determined based on a one-shot pulse signal transmitted from the encoder 196 (S102). Then, an output signal from the A/D converter 192 on the sampling point is sampled so as to store in the memory 194 as sampling data (S103). After "n" sampling data are stored in the memory 194 by repeating such a sampling per sampling point in the detection block (S104: Yes), the average value of the sampling data in the detection block is calculated (S105).

When the calculated average value in the detection block is less than a predetermined initial reference value (i.e. the received light amount is small) (S106: Yes), a possibility from multi-feeding is predicted. In such a case, the possibility is further judged whether to meet a multi-feed determining condition (S109). The multi-feed determining condition is defined as a condition that when there are two sequential detection blocks predicted to have a possibility for multi-feeding, it is determined that multi-feeding of sheets occurs. Note that other multi-feed determining conditions may be applicable. For instance, multi-feeding of sheets may be determined when more than half of detection blocks are determined as ones having a possibility for multi-feeding.

When the multi-feed determining condition is met as a result of the judgment (S109: Yes), a multi-feed detection signal is transmitted (S110). According to the transmitted signal, the printing apparatus 10 executes multi-feed control processing (S111). Multi-feed control processing means for instance that sheet feeding is stopped so as to move the transfer belt 253 downward by the transfer belt move-down mechanism 354. Thus, sheets are placed on the transfer belt moved downward so that a user can easily remove the sheets from the printing apparatus 10.

When the calculated average value in the detection block is more than the predetermined initial reference value (i.e. the received light amount is large) (S106: No), or when the multi-feed determining condition is not met (S109: No), the calculated average value is stored in the memory 194 as a reference value of the detection block (S107).

Then, the multi-feed determiner 190 executes multi-feed determination processing repeatedly (starting from the step S102) until a back edge part of the sheet is detected (S108). When the second light transmission sensor 170 detects the back edge part of the sheet (S108: Yes), multi-feed determination processing in first sheet feeding is completed.

Next, we explain multi-feed determination processing of a following sheet after first sheet feeding with reference to a flow chart in FIG. 8.

When the second light transmission sensor 170 detects a front edge part of a following sheet after first sheet feeding (S201: Yes), a sampling point in a first detection block is determined based on a one-shot pulse signal transmitted from the encoder 196 (S202). Then, an output signal from the A/D converter 192 on the sampling point is sampled so as to store in the memory 194 as sampling data (S203). After "n" sampling data are stored in the memory 194 by repeating such a sampling per sampling point in the detection block (S204: Yes), the average value of the sampling data in the detection block is calculated (S205).

When the calculated average value in the detection block is less than the reference value of the corresponding detection block determined in first sheet feeding (i.e. the received light amount is small) (S106: Yes), a possibility for multi-feeding is predicted. In such a case, the possibility is further judged whether to meet a multi-feed determining condition (S209). Note that the similar multi-feed determining condition to the first sheet can be employed in this feeding.

When the multi-feed determining condition is met as a result of the judgment (S209: Yes), a multi-feed detection signal is transmitted (S210). According to the transmitted signal, the printing apparatus 10 executes multi-feed control processing (S211). Note that multi-feed control processing similar to the first sheet can be employed in this feeding.

When the calculated average value in the detection block is more than the reference value (i.e. the received light amount is large) (S206: No), or when the multi-feed determining condition is not met (S209: No), the multi-feed determiner 190 executes multi-feed determination processing repeatedly (starting from the step S202) until a back edge part of the sheet is detected (S207). When the second light transmission sensor 170 detects the back edge part of the sheet (S207: Yes), the multi-feed determiner 190 determines whether a sheet is still following (S208). When there is another following sheet (S208: Yes), the multi-feed determiner 190 repeats multi-feed determination processing starting from front edge part detection processing (S201). While, when there is no following sheet (S208: No), multi-feed determination processing after first sheet feeding is completed.

According to the present embodiment as described above, the printing apparatus 10 employs the second light transmission sensor 170 as a multi-feed detection sensor provided on the sheet exit side of the register rollers 250 in order to detect edge parts of a sheet. Thus, it is possible to improve the accuracy of multi-feed detection.

While preferred embodiments of the present invention have been described using specific terms, such description is for illustrative purposes, and it is to be understood that changes and variations may be made without departing from the spirit or scope of the following claims.

This application is based upon the Japanese Patent Application No. 2008-226285, filed on Sep. 3, 2008, the entire content of which is incorporated by reference herein.

What is claimed is:

1. A printing apparatus, comprising:

a printing mechanism forming an image on a sheet transferred in a sheet transfer route;

a sheet feeding mechanism feeding sheets to the sheet transfer route;

a register provided between the sheet feeding mechanism and the printing mechanism on the sheet transfer route so as to position a sheet fed from the sheet feeding mechanism and adjust an obliqueness of the sheet;

an edge part detector provided on the sheet transfer route having a detecting section configured between the register and the printing mechanism so as to detect edge parts of a sheet transferred to the printing mechanism by the register, wherein the edge part detector is configured to serve as a multi-feed detector to detect multi-feeding of sheets, wherein the edge part detector includes a light transmission sensor provided with a light emitter and a light-receiving sensor, and detects multi-feeding of sheets by sampling output signals from the light-receiving sensor in a plurality of sampling points in detection blocks preliminarily set on a sheet.

* * * * *